US008220094B2

(12) United States Patent
Kennedy et al.

(10) Patent No.: US 8,220,094 B2
(45) Date of Patent: Jul. 17, 2012

(54) REINFORCED MINE VENTILATION DEVICE

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 432 days.

(21) Appl. No.: 12/504,849

(22) Filed: Jul. 17, 2009

(65) Prior Publication Data

US 2010/0017975 A1 Jan. 28, 2010

Related U.S. Application Data

(60) Provisional application No. 61/084,012, filed on Jul. 28, 2008.

(51) Int. Cl.

| | |
|---|---|
| ***E01D 6/00*** | (2006.01) |
| ***E01D 1/00*** | (2006.01) |
| ***B63C 11/10*** | (2006.01) |
| ***E21F 3/00*** | (2006.01) |

(52) U.S. Cl. ..... 14/6; 14/78; 405/288; 454/168

(58) Field of Classification Search ..... 454/168–172; 404/6, 78; 14/6, 78; 405/272, 288

See application file for complete search history.

(56) References Cited

U.S. PATENT DOCUMENTS

| | | | | |
|---|---|---|---|---|
| 440,437 | A * | 11/1890 | Phillips | 14/6 |
| 530,425 | A * | 12/1894 | Keating | 14/6 |
| 534,032 | A * | 2/1895 | Clymer | 14/6 |
| 1,889,512 | A * | 11/1932 | Auten | 52/643 |
| 1,923,008 | A | 8/1933 | Proctor | |
| 2,629,906 | A * | 2/1953 | Holmes | 403/73 |
| 3,375,624 | A * | 4/1968 | Mikulin | 52/109 |
| 3,504,389 | A * | 4/1970 | Longbottom | 14/13 |
| 4,366,655 | A * | 1/1983 | Mayer et al. | 52/223.7 |
| 4,589,157 | A * | 5/1986 | Richard | 14/73 |
| 4,621,951 | A | 11/1986 | Dewson | |
| 5,412,916 | A | 5/1995 | Kennedy | |
| 5,466,187 | A | 11/1995 | Kennedy | |
| 5,680,664 | A * | 10/1997 | Head | 14/4 |
| 6,256,946 | B1 | 7/2001 | Kennedy | |
| 6,264,549 | B1 | 7/2001 | Kennedy | |
| 6,334,738 | B1 * | 1/2002 | Juracko | 405/132 |
| 6,379,084 | B1 * | 4/2002 | Kennedy et al. | 405/132 |
| 6,669,551 | B2 | 12/2003 | Kennedy | |
| 7,082,637 | B1 * | 8/2006 | Griffin | 14/69.5 |
| 7,182,687 | B2 | 2/2007 | Kennedy | |
| 7,232,368 | B2 | 6/2007 | Kennedy | |

FOREIGN PATENT DOCUMENTS

| | | |
|---|---|---|
| GB | 1382333 | 1/1975 |

* cited by examiner

*Primary Examiner* — Thomas B Will
*Assistant Examiner* — Abigail A Risic
(74) *Attorney, Agent, or Firm* — Senniger Powers LLP

(57) ABSTRACT

A mine ventilation and bridge structure incorporating a bridge feature enabling a mine vehicle to cross over the structure. The structure comprises a pair of generally parallel and spaced-apart side walls defining opposing side walls and a plurality of elongate deck panels extending between the side walls. At least one deck panel of the plurality of deck panels is a reinforced bridge deck panel constructed to support the weight of a vehicle crossing over the mine ventilation and bridge structure.

24 Claims, 19 Drawing Sheets

REINFORCED MINE VENTILATION DEVICE

CROSS-REFERENCE TO RELATED APPLICATION

This application claims priority from U.S. Patent Application No. 61/084,012 (provisional), filed Jul. 28, 2008.

FIELD OF THE INVENTION

The invention relates generally to mine ventilation structures and more particularly to reinforced mine ventilation structures capable of supporting vehicles crossing over the structures and/or withstanding very high air pressure differentials.

BACKGROUND OF THE INVENTION

Mine ventilation structures such as overcasts and undercasts are widely used in mines to prevent mixing of forced (or induced) ventilation air flowing in one passage with forced (or induced) ventilation air flowing in another passage at an intersection of those passages. Generally, an overcast comprises a tunnel (e.g., made of two sidewalls and a deck) erected in one of the passages and extending through the intersection with the other passage. The tunnel blocks communication of air between the passages at the intersection, but permits air in one of the passages to flow through the tunnel and permits air in the other passage to flow through the intersection in a space between the top of the tunnel and the deck. Additional details relating to the construction and operation of overcasts are provided in our U.S. Pat. Nos. 5,412,916, 6,264,549, 5,466,187, 7,182,687 and 7,232,368, all of which are incorporated herein by reference. An undercast is similar to an overcast, but the tunnel is constructed adjacent the roof of the intersection (e.g., the sidewalls and deck are inverted and suspended above the floor). Air in one of the passages flows through the tunnel of the undercast and the air in the other passage flows through the intersection in a space between the bottom of the tunnel and the floor of the intersection.

Ventilation structures are desirably relatively lightweight and relatively small so that they are easy to assemble and do not unnecessarily restrict airflow through the passage.

SUMMARY OF THE INVENTION

In one aspect, the invention is directed to a mine ventilation and bridge structure for installation in a mine. The ventilation and bridge structure incorporates a bridge feature enabling a mine vehicle to cross over the structure. The ventilation and bridge structure comprises a pair of generally parallel, spaced-apart side walls defining opposing side walls of the first lower passage, and a plurality of elongate unitary deck panels extending between the side walls and forming a deck of the first lower passage and a floor of the second upper passage. The unitary deck panels comprise, in transverse cross section, a generally planar upper web and one or more stiffening members on the web. The deck panels are adapted to be placed on the side walls in a side-by-side relation with the deck panels closely adjacent one another so that the webs of the panels form a substantially continuous deck surface. The deck panels so placed are capable of independently supporting their own weight. Further, at least one deck panel of the plurality of deck panels is a reinforced bridge deck panel constructed such that the mine ventilation and bridge structure can support the weight of a vehicle crossing over the structure. The reinforced bridge deck panel comprises a reinforcing structure comprising either a beam or a truss extending lengthwise of the bridge deck panel substantially the full length of the bridge deck panel below the web of the bridge deck panel.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

FIGS. 2A-4A are side elevations (profiles) of the reinforced bridge deck panels of FIGS. 2-4;

Corresponding parts are indicated by corresponding reference characters throughout the drawings.

DETAILED DESCRIPTION

Figure 1:
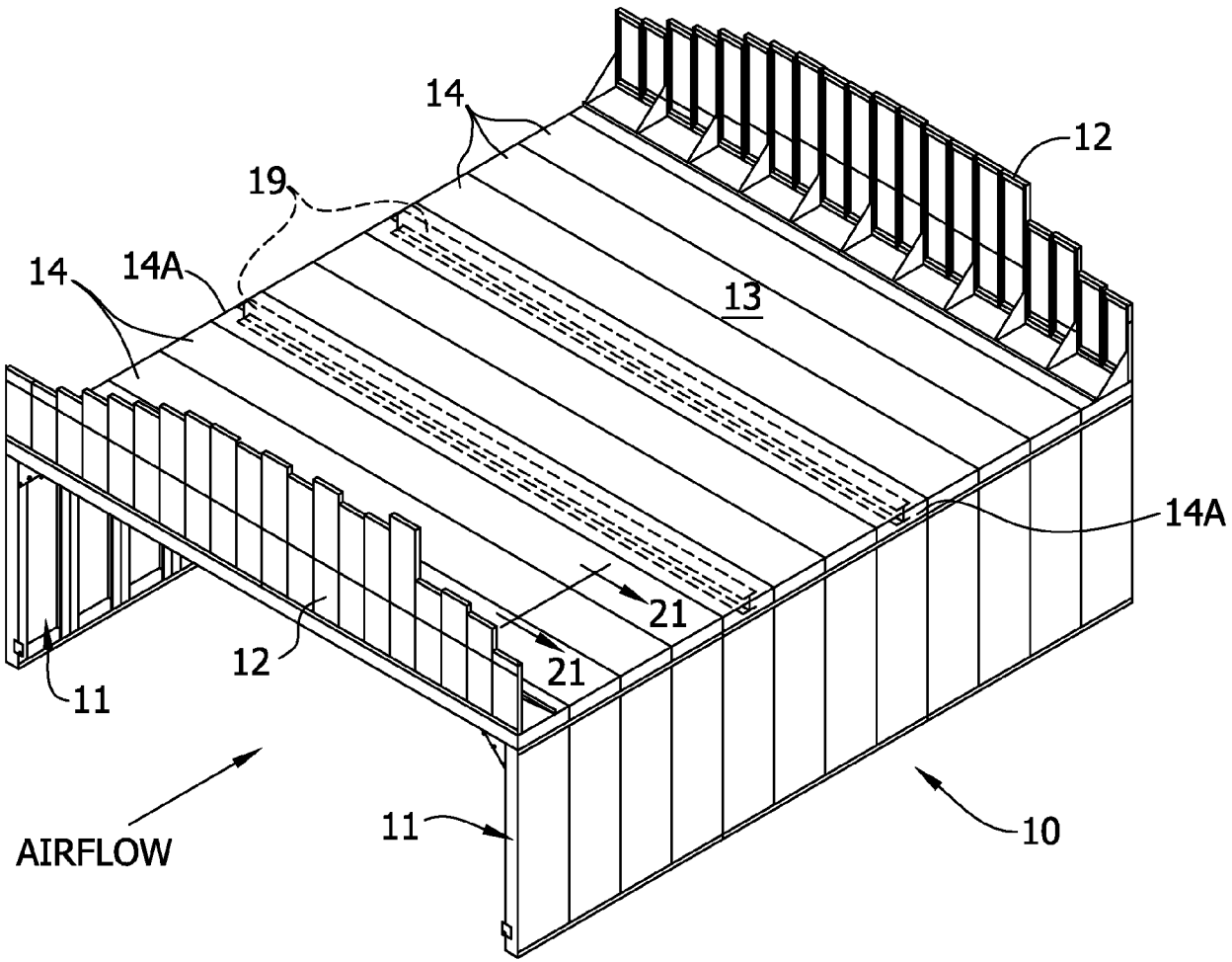
FIG. 1 is a perspective view of a first embodiment of a mine ventilation structure of the present invention.
Figure 2:
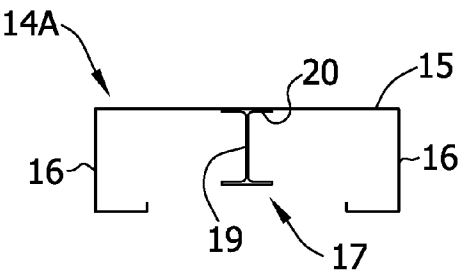
FIGS. 2-4 are end views of different embodiments of reinforced bridge deck panels.

Referring to FIGS. 1-2, in one embodiment a ventilation structure 10 includes a first set of opposing walls 11 supporting a deck 13. The deck 13 and walls 11 form a tunnel for airflow through the ventilation structure. A second set of opposing walls 12 is optionally mounted on the deck 13 to guide airflow over the deck 13. This structure may be erected according to the above-identified patents or by other suitable methods. Air flows through the passageway under the deck and between the first set of walls. The ventilation structure typically functions as a mine overcast or a mine undercast for segregating air flow at the intersection of two or more passageways in a mine, but other applications are possible.

The deck 13 of this embodiment includes a plurality of deck panels 14. Each deck panel comprises an upper web 15 and one or more stiffening members 16 on the web. In one embodiment, the deck panels 14 are of the type described in my U.S. Pat. No. 5,466,187, i.e., each panel is a unitary member generally of channel shape formed from sheet metal, and the stiffening members 16 comprise inwardly turned side flanges on the underside of the web 15 at opposite sides of the panel. Other deck panel configurations are suitable, including unitary panels having other types of stiffening members extending along the panels at opposite sides of the panels. Non-unitary panels fabricated from multiple parts are also within the scope of this invention. The deck panels 14 are placed on the side walls 11 in a side-by-side relation such that the webs 15 of the panels form a substantially continuous planar deck surface. As thus placed, the deck panels 14 are capable of independently supporting their own weight.

The side walls 11 can be constructed from panels having the same configuration as the panels 14 forming the deck. Alternatively, the side walls 11 can be constructed from panels or other structures having a different configuration. By way of example, the side walls may be masonry side walls or simple abutments.

As shown in FIG. 2, the deck panels 14 include one or more (e.g., two) bridge deck panels 14A that are reinforced to permit passage of vehicles over the mine ventilation structure. Each of the bridge deck panels 14A has a construction similar to a deck panel 14 except that the bridge deck panel 14A is reinforced with a reinforcing structure, generally designated 17, extending substantially the full length of the deck panel 14A on the underside of the deck panel. In FIG. 2, the reinforcing structure 17 comprises a longitudinally extending beam 19, e.g., an I-beam, extending lengthwise of the deck panel above or below the web 15 of the panel. The beam increases the strength and the section modulus of the deck panel 14A. In one embodiment, the I-beam 19 is mounted with one of its flanges 20 attached to the underside of the web 15 of the bridge deck panel 14A. The I-beam may be attached to the bridge deck panel 14A by welding or other suitable methods. The beam may have cross-sectional shapes other than an "I" shape, including, without limitation, a "U" shape, "L" shape, "hat" shape, and square tube.

Figure 3:
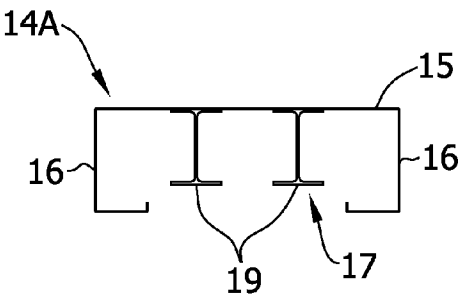
Figure 4:
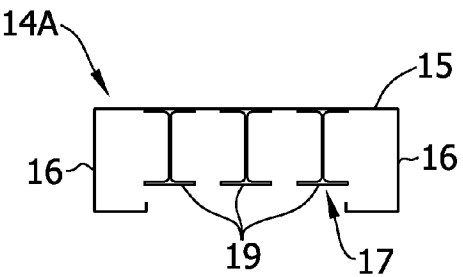

In the variations shown in FIGS. 3 and 4, the reinforcing structure 17 comprises a plurality of beams 19 (two beams in FIG. 3, three beams in FIG. 4) attached to the bridge deck panel 14A. Other types and configurations of beam reinforcement structures are contemplated within the scope of the invention. Also, more or less than two reinforced bridge deck panels 14A may be used in a deck.

The reinforcing beam(s) 19 of the FIGS. 1-4 embodiment is made of thicker gauge material than that of the web 15 and stiffening flanges 16. By way of example but not limitation, a standard deck panel is made of 14-gauge sheet steel (minimum 0.070 inches thick) and has an overall depth, as measured from the upper surface of the web to the bottom of the stiffening flanges 16, of four, six or eight inches depending on the section modulus required for the application. The section modulus may take into account the air load on the structure, the length of the span and the weight or load of the anticipated vehicle traffic.

Figure 2A:
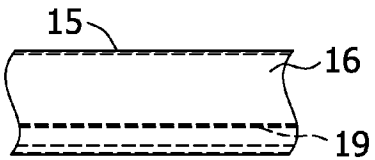
Figure 3A:
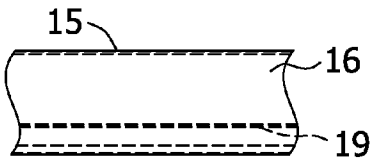
Figure 4A:
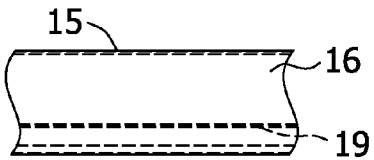

In the embodiments of FIGS. 1-4, the reinforcing beam(s) 19 does not project below the stiffening members 16 of the deck panel. As a result, the beam(s) does not interfere with airflow through the passageway. In general, to keep airflow resistance to a minimum it is desirable that the vertical side profile of the beam structure extending transverse to the direction of airflow not be substantially greater than the vertical side profile of the one or more stiffening members 16. (Exemplary vertical side profiles are shown in FIGS. 2A, 3A and 4A.) In this regard, it is desirable that the vertical side profile of the beam structure 17 not extend a distance of more than about 12.0 in. below the vertical side profile of the one or more stiffening members 16, and it is even more desirable that this distance be less than 12.0 in, even more desirably less than 11.0 in., even more desirably less than 10.0 in., even more desirably less than 9.0 in., even more desirably less than 8.0 in., even more desirably less than 7.0 in., even more desirably less than 6.0 in., even more desirably less than 5.0 in., even more desirably less than 4.0 in., even more desirably less than 3.0 in., even more desirably less than 2.0 in., and even more desirably less than 1.0 in. From the standpoint of minimizing resistance to airflow, it is most desirable that the beam structure not extend any distance below the stiffening flanges 16. Alternatively, or in combination, the reinforcing structure 17 below the deck 13 is made to have a very thin profile (e.g., edges of plates as opposed to formed shapes, tubes or the like) to keep air resistance to a minimum.

In general, the section modulus of the reinforcing beam structure 17 is chosen so that it will "stress up" at about the same rate as the deck panel 14, 14A. In this way, the section modulus of one is not wasted due to the lower section modulus of the other.

Figure 5:
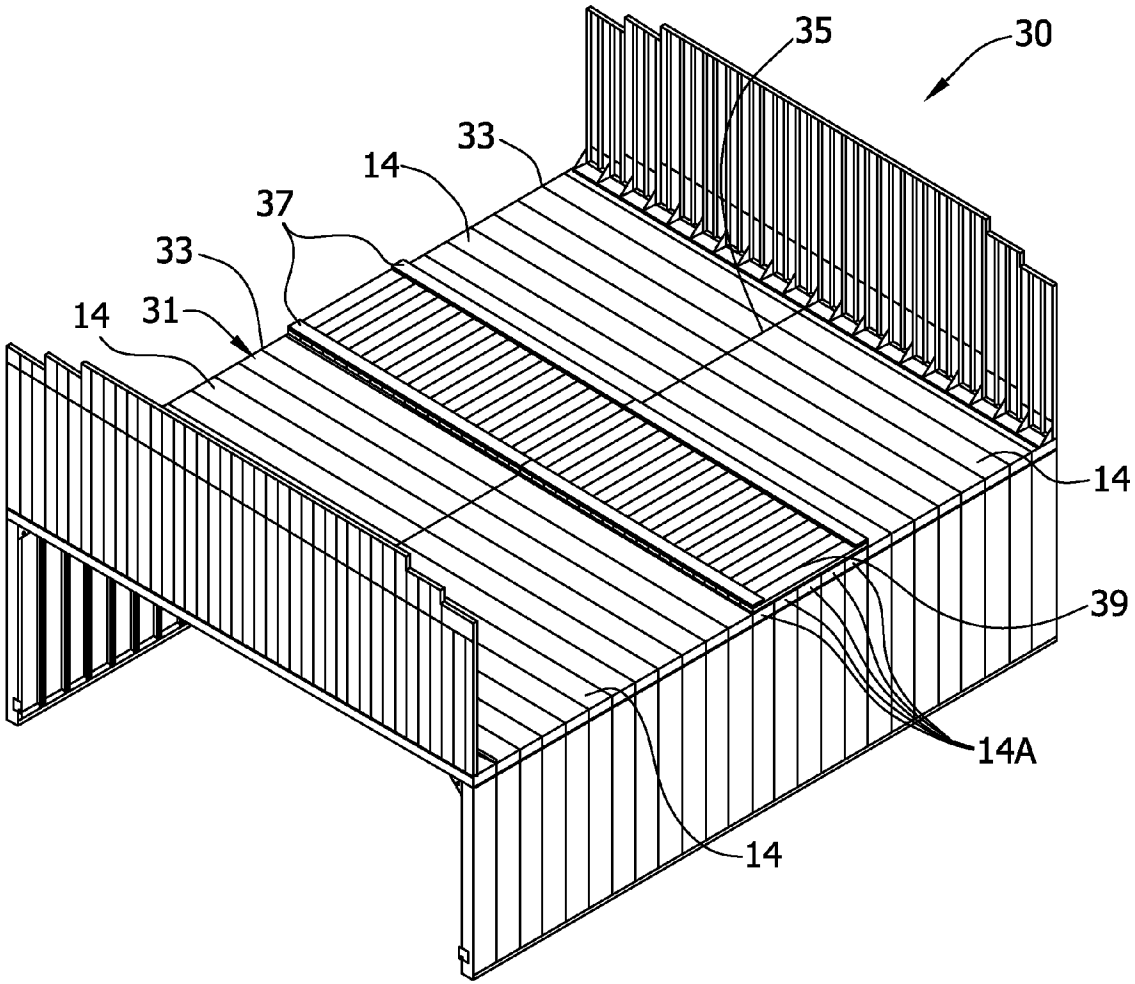
FIG. 5 is a perspective view of a second embodiment of a mine ventilation structure of the present invention.

FIG. 5 shows a ventilation structure 30 having a deck 31 comprising two groups of deck panels 14 forming two deck sections 33 attached along a center seam 35. In one example, the sections 33 are twenty feet long and combine to make a 40-foot deck. As shown, the deck 31 includes runners 37 which are secured to one or more reinforced bridge deck panels 14A. The runners 37 extend upward from the main surface of the deck. Slats 39 between the runners extend perpendicular to the runners. In this case, the deck 31 is eight inches thick. The reinforcing beam structure (not shown) is positioned on the underside of the bridge deck panels 14A. This beam structure may be similar to the beam structure 17 described above.

Figure 6:
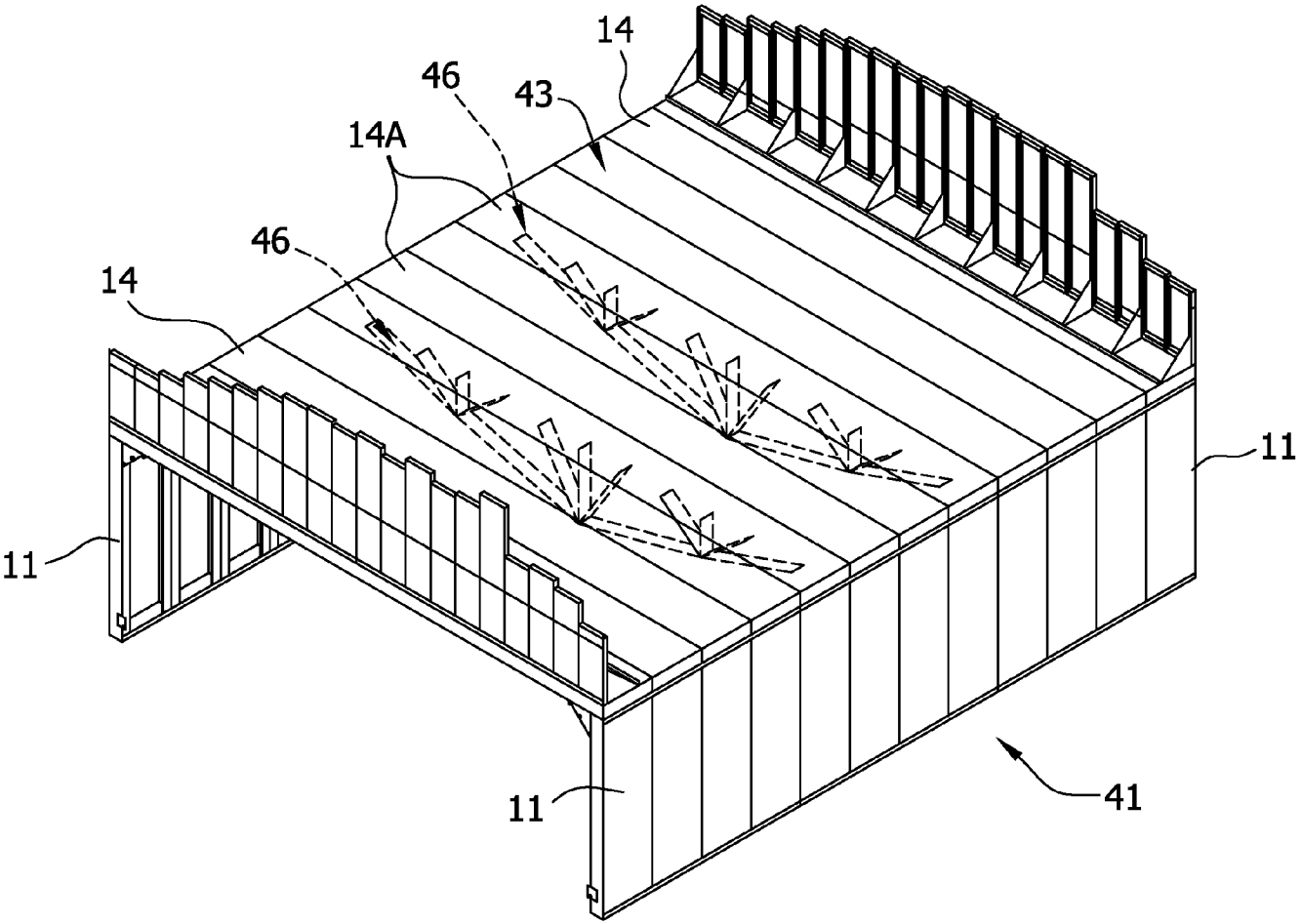
FIG. 6 is a perspective view of a third embodiment of a truss-reinforced mine ventilation structure of the present invention.
Figure 7:
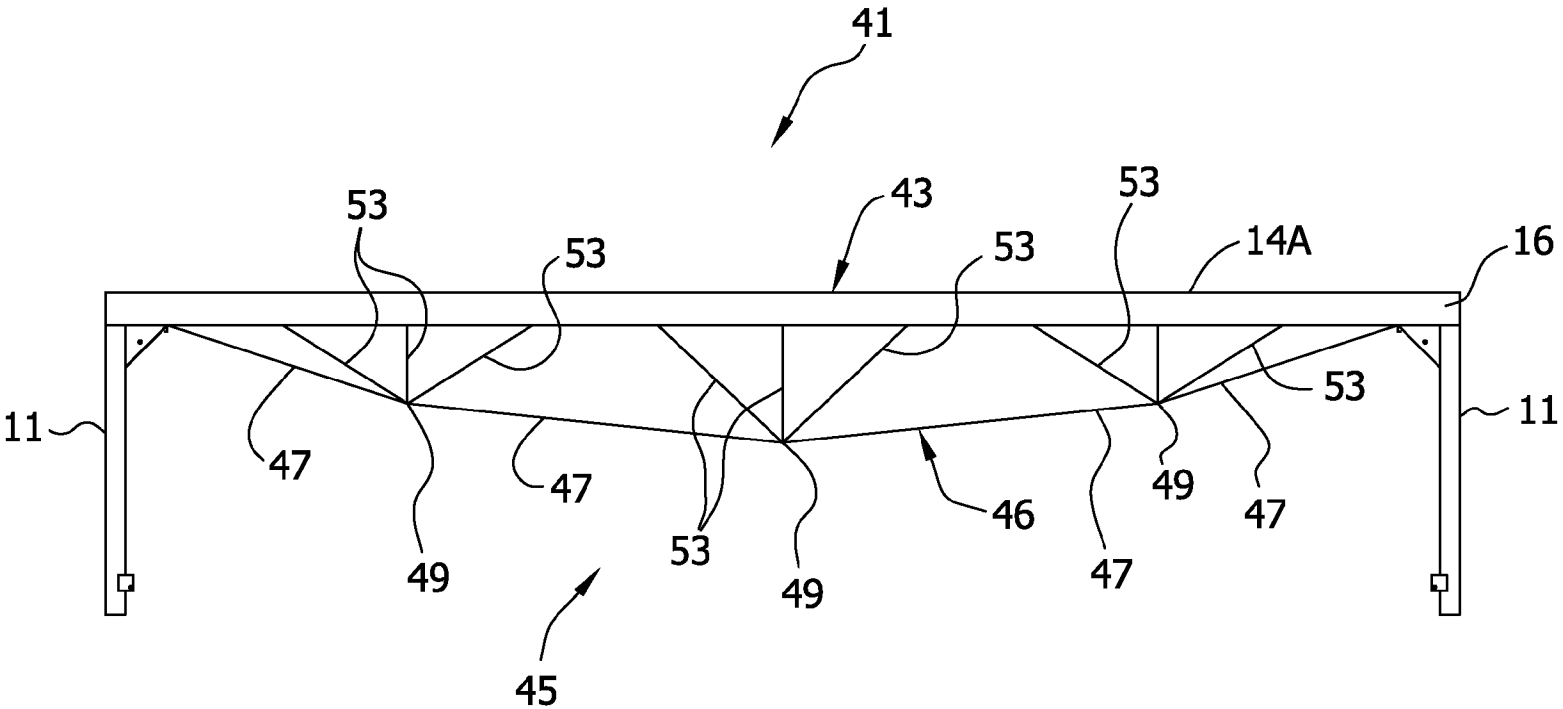
FIG. 7 is an end elevation of the structure of FIG. 6.

FIGS. 6-7 illustrate a ventilating structure 41 having a deck 43 fabricated from bridge deck panels 14A reinforced by reinforcing truss structures, each generally designated 45, extending substantially the full length of the deck panels below the deck surface. (The length or bridge span of a deck panel can vary widely, but in coal mines the length is generally between 16 and 30 feet. In hard rock mines, the length can be 60 to 80 feet or more.) Two reinforced bridge deck panels 14A are shown, though more or less are contemplated. The reinforcing truss structures 45 may be used in applications where additional strength or effective section modulus is needed. In one embodiment, each truss structure 45 comprises a truss 46 attached to the web 15 of a respective deck panel 14A on the underside of the deck panel 14A. Alternatively, the truss 46 may be formed or fabricated integrally with one or more stiffening members 16 of the deck panel 14A. As shown, the truss 53 extends well below the bottom of the deck (below the flanges 16 on the deck panels 14A).

As a general proposition, the reinforcing trusses 46, like the reinforcing beams 19 described above, should be designed to keep air resistance to a minimum. In the illustrated embodiment, each truss 46 is fabricated from a plurality of plates, including a first series of lower plates 47 which are hinged together at hinge connections 49 to form a "chain" of plates spanning the underside of the deck 51, and a second series of tie plates 53 interconnecting the lower plates 47 and the deck. The plates 47, 53 are oriented generally parallel to the direction of airflow, that is, with their thin edges facing into the airflow, thus reducing resistance to airflow.

Figure 7A:
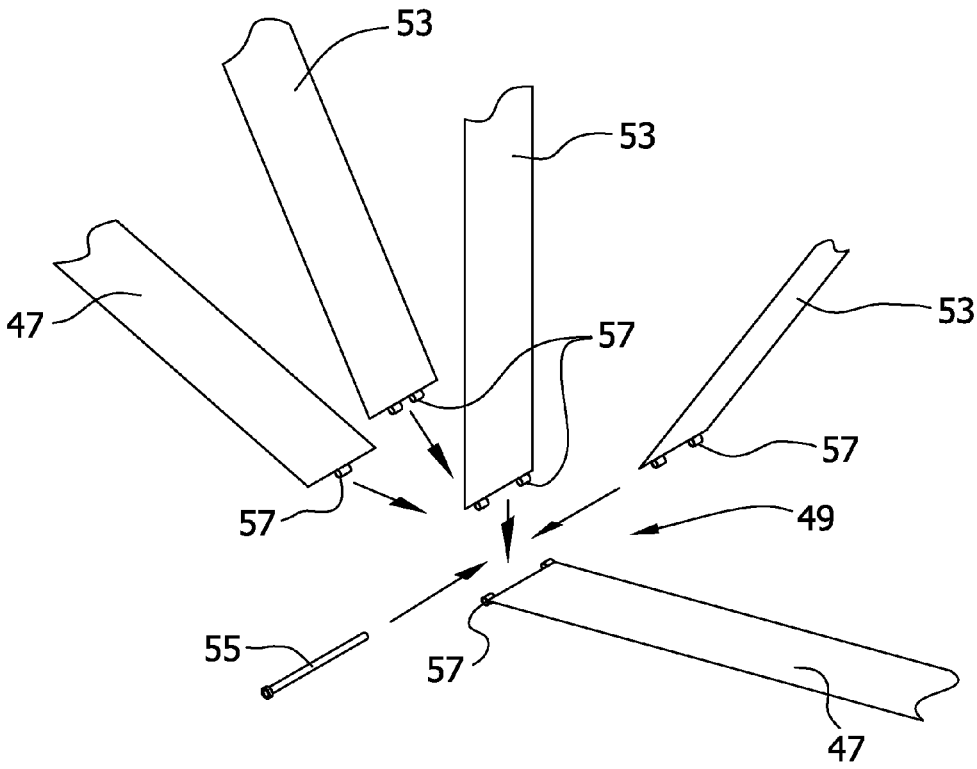
FIGS. 7A and 7B are perspective views of a connection between the plate members of a reinforcing truss structure.
Figure 7B:
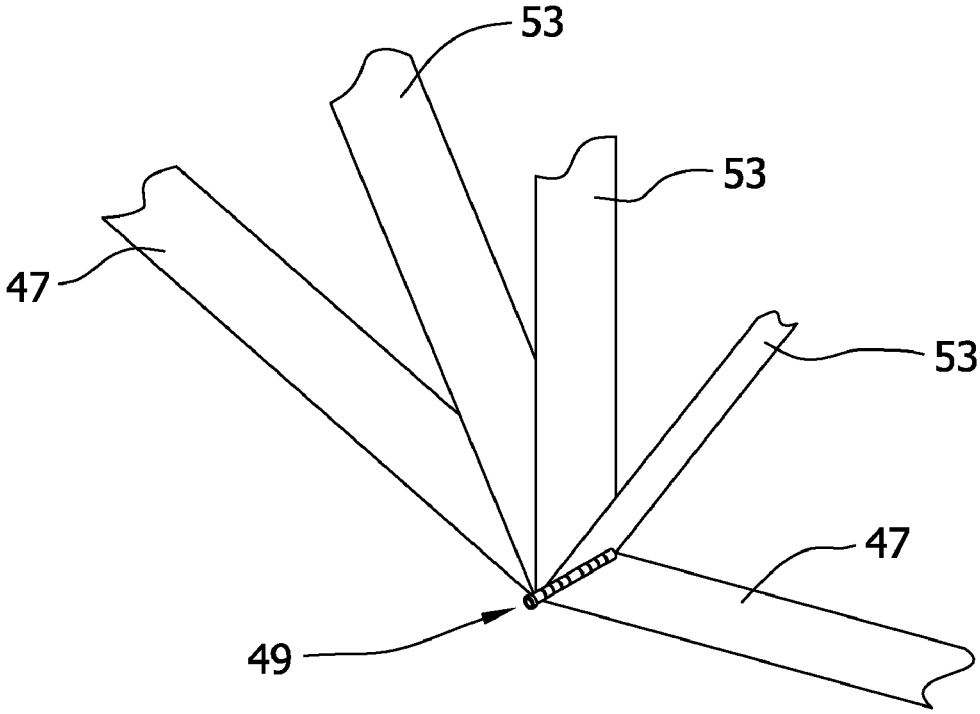

FIGS. 7A and 7B show an exemplary connection 49 between two lower plates 47 and tie plates 53 of the truss 46. This connection 49 comprises a pin 55 received through a series of aligned sleeves 57 on respective plates 47, 53. Other types of connections 49 may be used. When the deck is loaded, the tie plates 53 below the load are placed in compression, which results in all of the other tie plates being placed in compression as the "chain" of lower plates 47 goes into tension. (As the "chain" tries to straighten, the tie plates 53 are loaded in compression.) This design has several advantages. It is simple, the parts are light, and few if any tools are needed for assembly.

Figure 8:
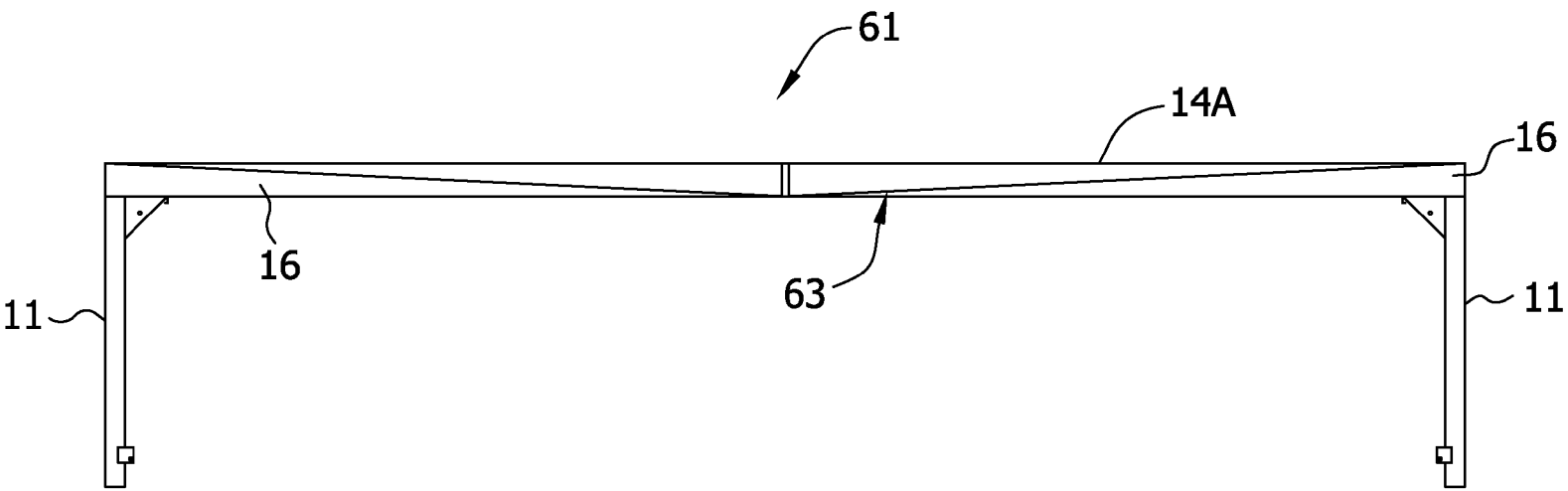
FIG. 8 is an end elevation of a fourth embodiment of a truss-reinforced mine ventilation structure of the present invention.
Figure 9:
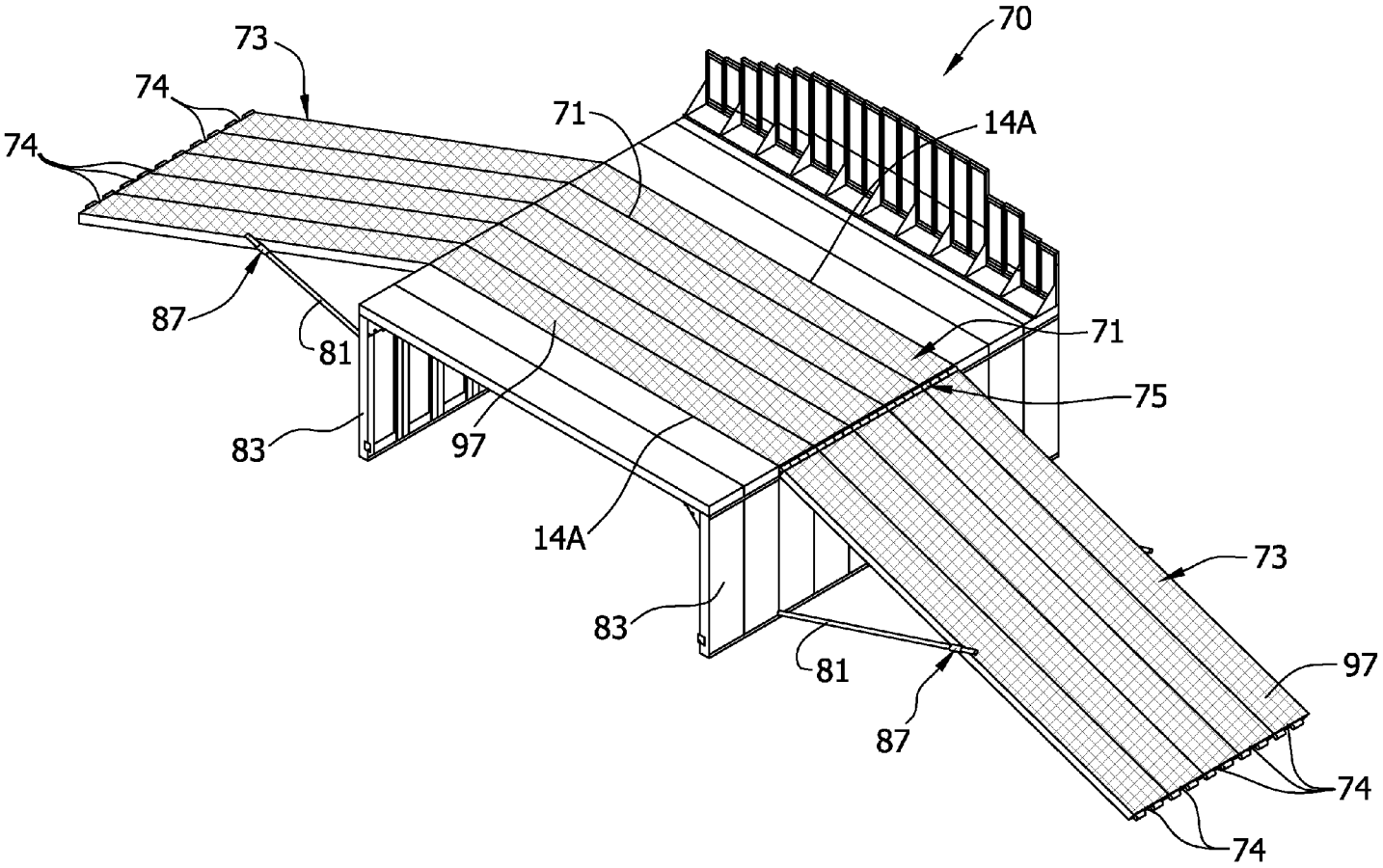
FIG. 9 is a perspective view of a fifth embodiment of a mine ventilation structure having ramps for vehicles crossing over the structure.

The reinforcing truss structures 45 illustrated in FIGS. 6 and 7 are merely exemplary. Other types of reinforcing truss structures are contemplated. For example, FIG. 8 shows a ventilating structure 61 reinforced by a truss 63 that does not extend below the flanges 16 of the deck panel 14A. By designing the truss 63 so that it has a vertical side profile which does not extend substantially below the vertical side profile of the one or more stiffening members 16 of the deck panel 14A, resistance to airflow is reduced.

The reinforcing beams and trusses 17, 45 described above can be complete structures which are functional independent of the deck panel 14A. Alternatively, they can be only partial structures which combine with the web 15 and one or more stiffening members 16 of the deck panel 14 to provide the necessary strength. For example, in the case of a truss, the deck itself can function as the compression member of the truss. It will be understood that one or more reinforcing beams and one or more reinforcing structures can also be used in combination or alone.

Regardless of how the bridge deck panels 14A are reinforced (i.e., either by beam or truss reinforcing structures), they are constructed to reinforce the ventilation structure so that it is capable of supporting not only its own weight but also an "air" load resulting from any ventilation pressure in the mine and a "vehicle" load resulting from vehicles crossing over the structure. In this regard, ventilation pressures can range from about zero (only a few hundredths of an inch of Water Gauge) to about twenty IWG (inches of Water Gauge). Ventilation pressures in excess of about 7.5 IWG are generally considered very high. The "air" load on any particular ventilation structure can be calculated by multiplying the surface area of the deck in square inches times a conversion factor of 0.0361 times the ventilation pressure in IWG. For example, if a deck panel 14 is two feet wide and spans 26 feet, it has a surface area of 52 square feet or 7488 square inches. If the ventilation structure is 20 feet wide (i.e., the combined width of ten panels 14, 14A) and the ventilation pressure is 20 IWG, the "air" load on the structure is 7488×0.0361×20 IWG×20 panels=54,060 pounds. Regarding vehicle load, exemplary vehicles crossing over the structure include trucks, shield haulers, continuous mining machines, personnel carriers, and the like. The weight of such vehicles can range from 500-100,000 pounds. Thus, depending on the type of traffic to be handled by a particular installation, the ventilation structure must be constructed to safely support vehicle loads of at least 500 pounds, or at least 1000 pounds, or at least 1500 pounds, or at least 2000 pounds, or at least 3000 pounds, or at least 4,000 pounds, or at least 5,000 pounds, or at least 10,000 pounds, or at least 15,000 pounds, or at least 20,000 pounds, or at least 50,000 pounds, etc., or up to 100,000 pounds or more. Accordingly, the bridge deck panels 14, 14A must be constructed to support a "total" load ("air" load plus "vehicle" load) which is substantially greater than the capacity of prior mine ventilation structures.

Under conditions of atmospheric pressure (i.e., the "air" load is 0.0 IWG), it is desirable that the ventilation structure with reinforced bridge deck panels 14A be able to support a minimum vehicle load of at least about 700 pounds. Alternatively, the ventilation structure is reinforced to support any of the minimum vehicle loads stated in the preceding paragraph. For purposes of this description, a "vehicle load" is a point-concentrated load equal to the weight of a vehicle applied to the longitudinal center of a reinforced bridge deck panel 14A under conditions of atmospheric pressure. The vehicle load supported by each reinforced bridge deck panel will depend on how the weight of the vehicle is distributed as it crosses the structure. If the vehicle has a narrow "footprint" and contacts only one reinforced bridge deck panel, then that one panel must support the entire load. On the other hand, if the vehicle has a wider "footprint" and contacts more than one reinforced bridge deck panel at the same time, then each such panel must support a proportionate share of the load. Desirably, each reinforced bridge deck panel should be designed for the maximum vehicle weight it is expected to support, plus a reasonable safety factor.

Figure 11:
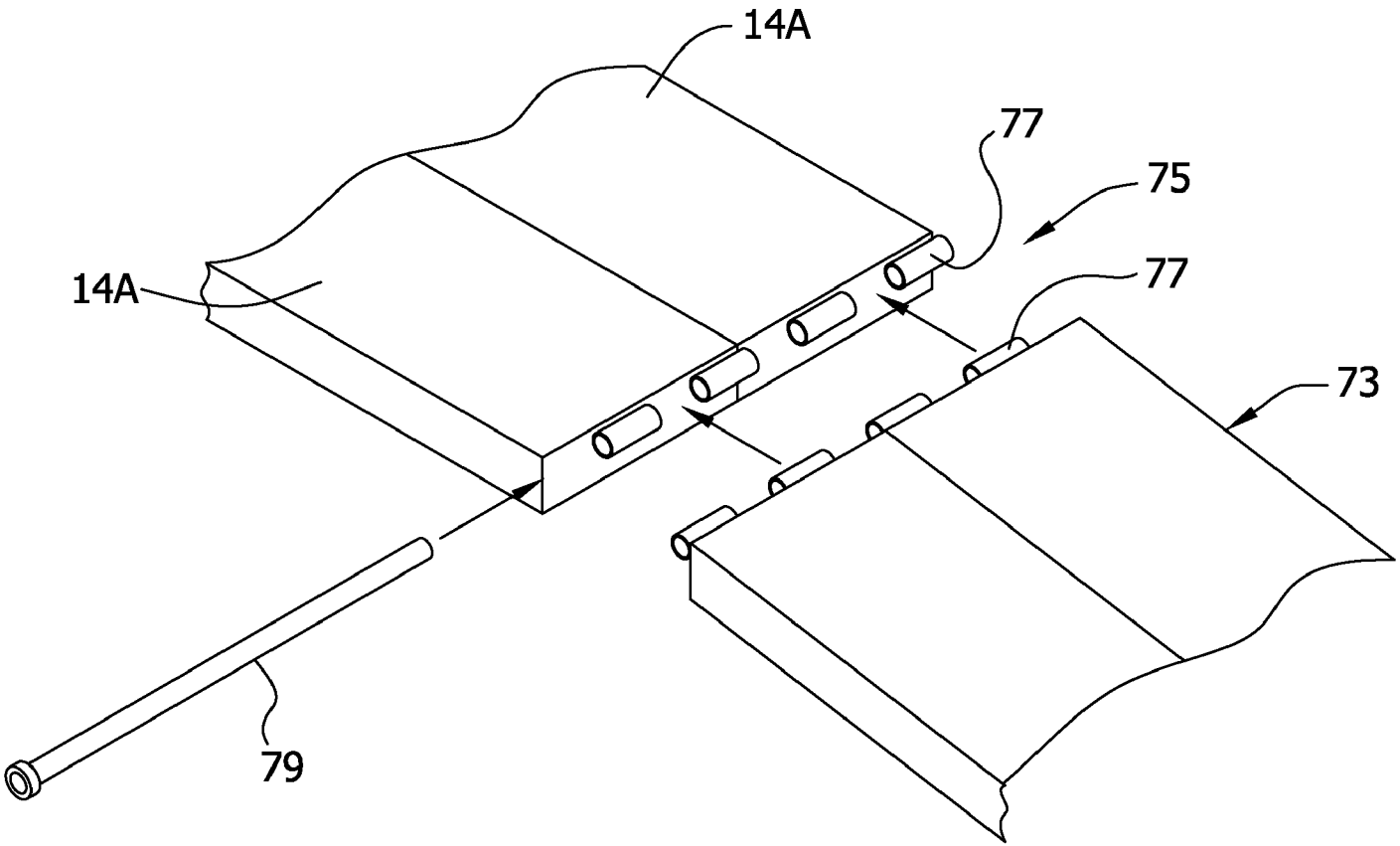
FIG. 11 is an exploded perspective of a connection between a ramp and a deck of the ventilation structure.

FIGS. 9-12 show a ventilation structure 70 which includes five reinforced bridge deck panels 14A forming a portion of the deck 72. Each bridge deck panel 14A comprises a reinforcing structure (not shown) as described above. Ramps 73 extend from the deck 72 to the mine floor (not shown). The ramps 73 likewise comprise a number of elongate ramp members 74 (e.g., similar to the deck panels 14, 14A) positioned side-by-side to form a generally planar sloping surface. The ramps 73 are joined to the reinforced deck panels 14A by connections 75. An exemplary connection 75 is shown in FIG. 11 as comprising a series of aligned sleeves (e.g., pipe sections 77) on the ramp and deck, and a hinge pin 79 extending through the sleeves. This type of hinge connection allows easy assembly and automatically relieves any stress on the connection in the event of a mine convergence or relative movement between parts. Other types of connections may be used.

Figure 12:
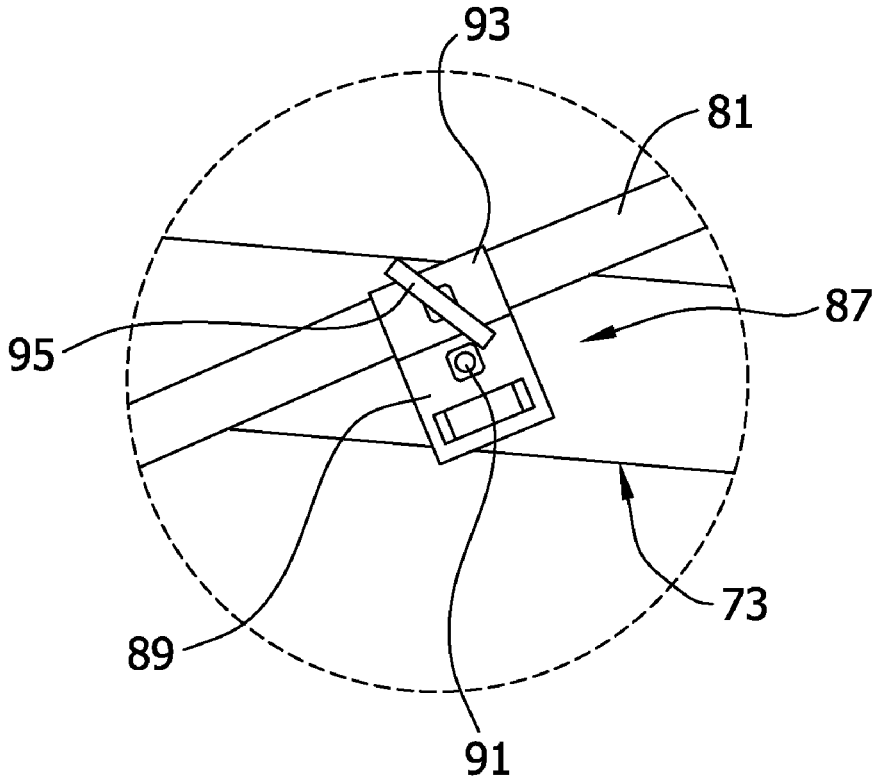
FIG. 12 is an enlarged portion of FIG. 10 showing a connection between a sway brace and a ramp.

The ramps 73 are further supported by sway braces 81 that extend from the side walls 83 of the structure 70 to the ramps. The braces 81 are suitably connected to the ramps through connections 87 that require no additional fasteners or tools to assemble. An exemplary connection 87 is shown in FIG. 12 as comprising a bracket 89 pivoted to the ramp 73 at 91 and having a tubular portion 93 for slidably receiving the upper end of a respective brace 81. The brace is held in position by threading a locking device 95 on the tubular portion 93 into friction contact with the brace 81. Other types of connections and locking devices can be used.

The ramps 73 and portions of the deck 72 may include traction means 97, such as expanded metal or the like, for increasing vehicle traction. The truck T (FIG. 10A) has 10 inches of ground clearance, so the "break-over" angle provided by the ramp 73 is sufficiently small that the truck can clear the connections 75 between the ramps and the deck.

Figure 10:
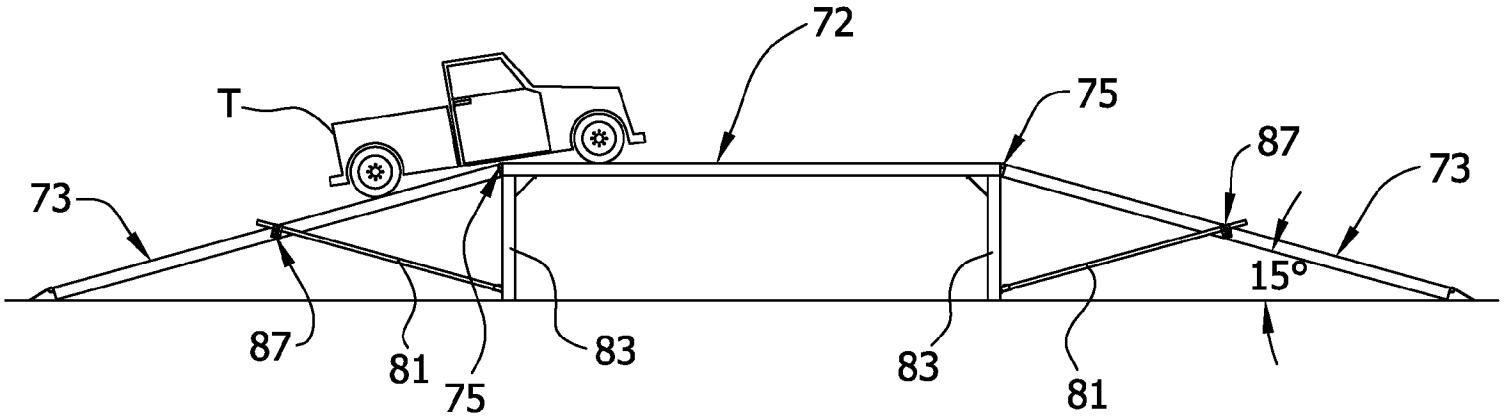
FIG. 10 is an end elevation of the structure of FIG. 9 showing a vehicle passing over the structure.
Figure 10A:
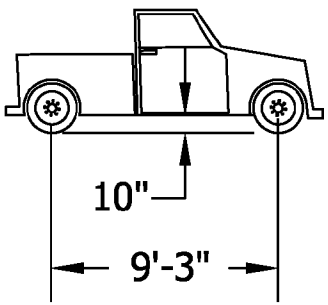
FIG. 10A is a view showing exemplary dimensions of the vehicle of FIG. 10.
Figure 13:
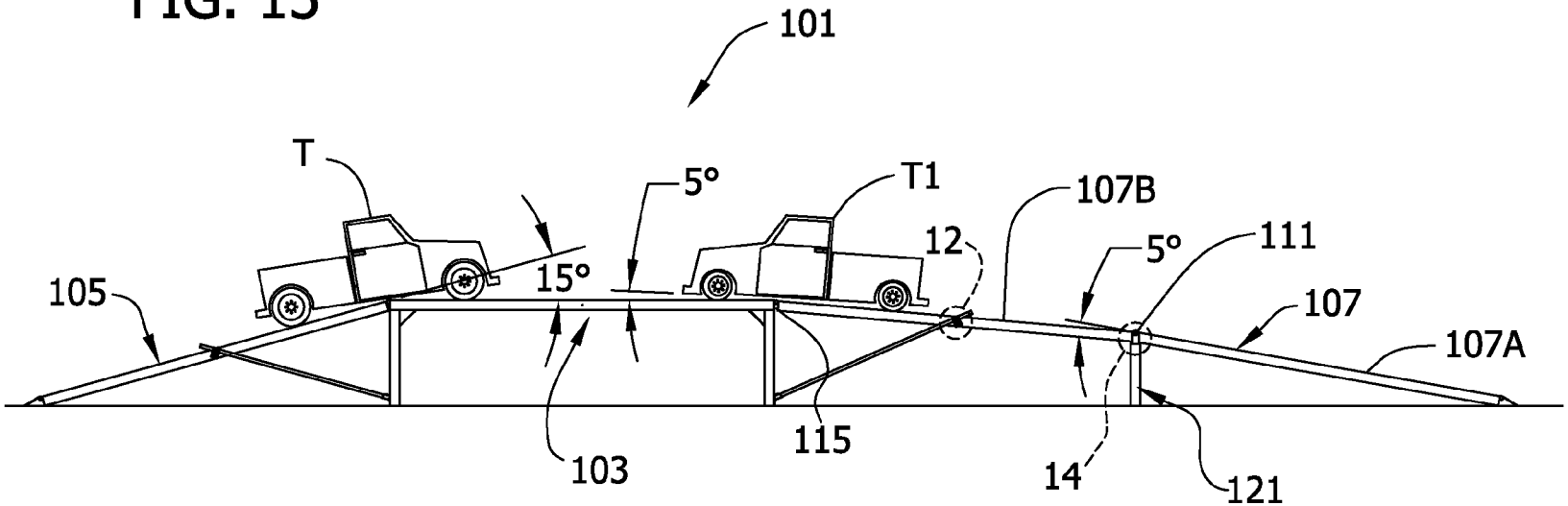
FIG. 13 is an elevation of a sixth embodiment of a mine ventilation structure of the present invention, with a different ramp design for vehicles crossing over the structure.
Figure 13A:
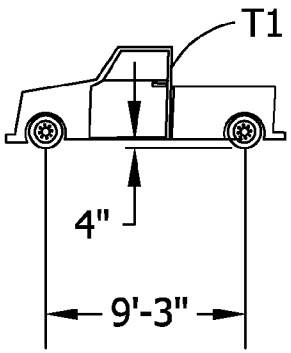
FIG. 13A is a view showing exemplary dimensions of a vehicle of FIG. 13.

In another embodiment shown in FIG. 13, a ventilation structure 101 includes a deck 103, a ramp 105 having one continuous section, and a ramp 107 having two sections (107A and 107B) connected by a joint 111. The two sections 107A, 107B of ramp 107 enable a less severe "break-over" angle at the junction 115 of the ramp 105 and the deck 103. The "break-over" angle that is required for the single-section ramp 105 can effectively be cut in half by using the two-section ramp 107 having two "break-over" angles instead of only one. (The first "break-over" angle is at the joint 111 and the second is at the junction 115 between the ramp and the deck.) In this way a truck having lower clearance, such as truck T1 shown in FIG. 13A, can clear the joint 111 and junction 115. Note that truck T1 has the same clearance as shown in FIG. 10A and is merely shown for comparison to truck T. Also note that the ramp 107 need not have a longer total length than ramp 105 to reduce the break-over angle. The joint 111 between the two ramp sections 107A, 107B and the junction 115 between the ramp 107 and the deck 103 may be constructed in a manner similar to the connection 75 shown in FIG. 11.

Figure 14:
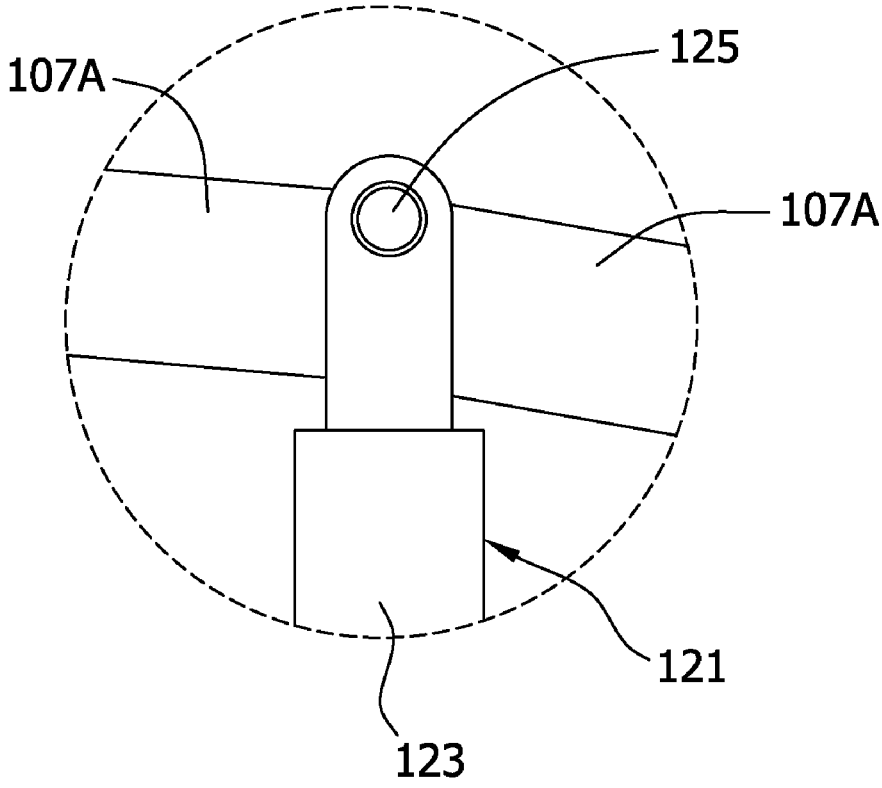
FIG. 14 is an enlarged portion of FIG. 13 showing parts of a stand for supporting one of the ramps.

Referring to FIGS. 13 and 14, the joint 111 between the ramp sections 107A, 107B may have a construction similar to the connection 75 between the deck 103 and the ramp 107 (see FIG. 11). Other types of connections are possible. The two-section ramp 107 is supported by a stand 121 adjacent the joint 111 between the two sections. The stand 121 comprises a pair of legs 123 on opposite sides of the ramp 107 (only one leg is shown in FIGS. 13 and 14). The legs 123 of the stand have pivot connections 125 with the ramp 107.

Figure 15:
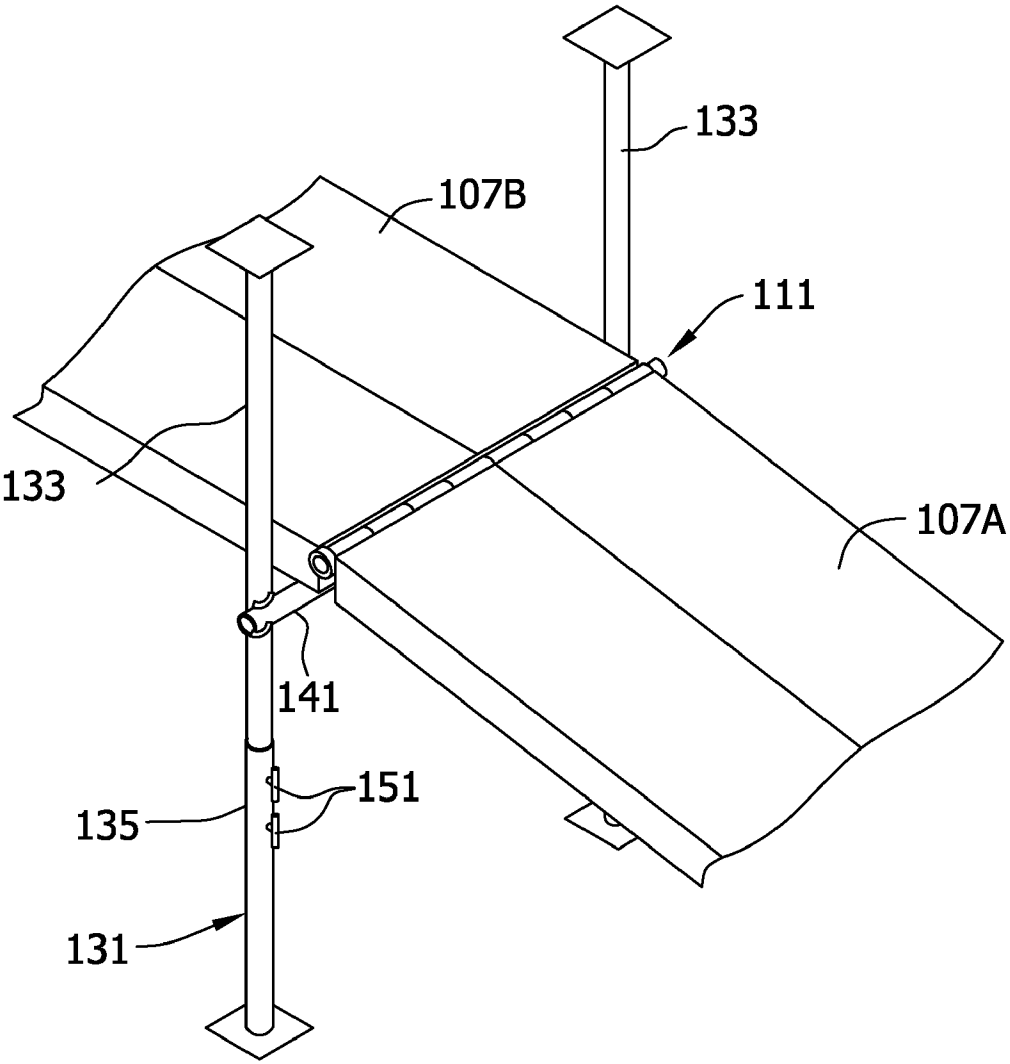
FIG. 15 is a perspective view of a second embodiment of a stand for supporting one of the ramps.

Also, the stand 121 may be modified to make it more robust and better withstand convergence. For example, FIG. 15 shows a stand 131 comprising telescoping upper and lower members 133, 135 on each side of the ramp 107, with each upper member extending upward to the roof of the mine. A cross member 141 is secured to the upper members and extends below the ramp 107 for supporting it in position. The elevation of the cross member 141 can be adjusted by telescoping the upper and lower members 133, 135 and then locking the members in adjusted position by tightening one or more locking devices, e.g., T-bolts 151 threaded through the lower members 135 into friction engagement with the upper members 133. Other locking mechanisms may be used. If there is convergence, the upper and lower members 133, 135 telescope together, as permitted by the friction locking devices 151, and the cross member 141 and ramp 107 supported by the cross member lower automatically to maintain clearance between the roof and the ramp.

Figure 16:
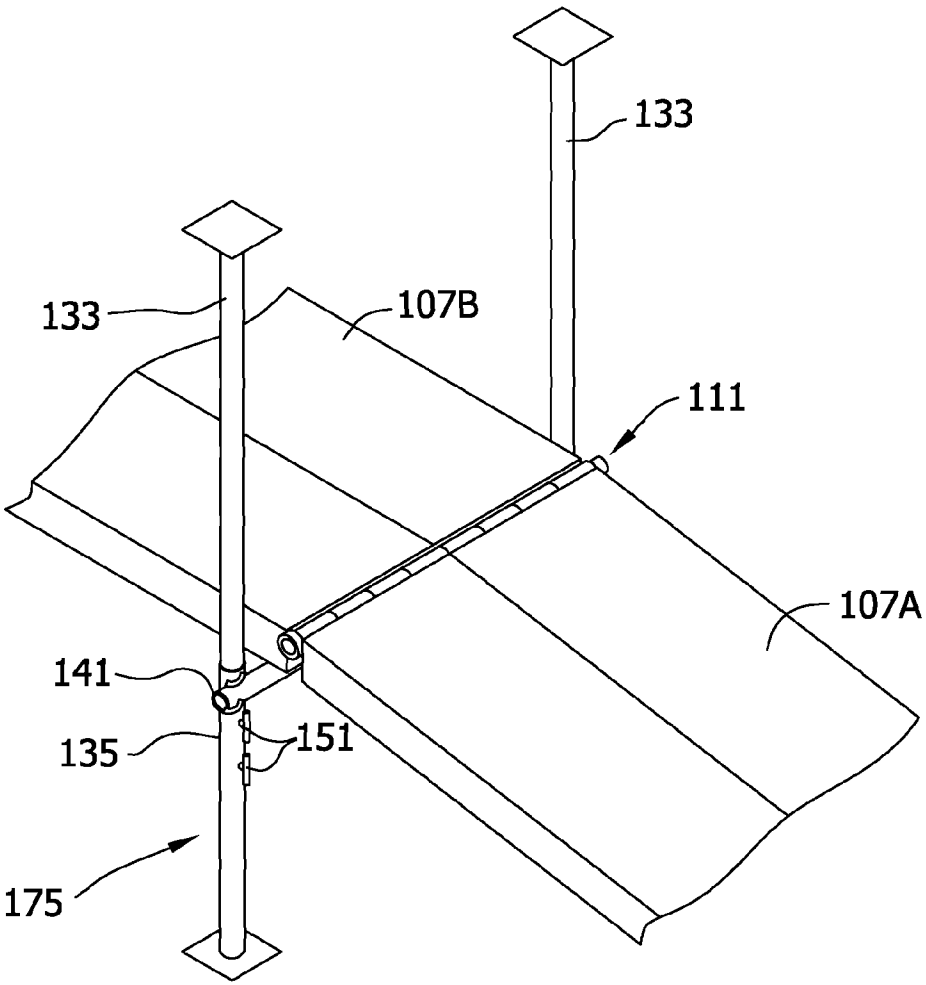
FIG. 16 is a perspective view of a third embodiment of a stand for supporting one of the ramps.

FIG. 16 shows a stand generally designated 175 similar to the stand shown in FIG. 15, and corresponding parts are indicated by corresponding reference numbers. In this embodiment, however, the cross member 141 is secured to the lower telescoping members for maintaining the clearance between the mine floor and the ramp.

As described above, the ramps (e.g., 73, 105 and 107) used to cross the ventilation structure can have various designs. By way of example, each ramp can have only one section or multiple (two or more) sections connected together. Further, each section can be generally planar or it can be configured as an upwardly-curved arch. The arch configuration is preferable where there is no intermediate support for the section.

The ventilation structures described above, including the walls 11 and the deck 13, can be manufactured with quick-connect features similar to the quick-connects described in the above-referenced patents. With such features, the structure can be assembled in the mine very quickly, and in some cases, with no tools required.

FIGS. 17-21 illustrate an exemplary method of assembling the deck panels 14 and side walls 11 of the ventilation structure 10. A bayonet connection system associated with the side walls 11 and deck panels 14 is used for connecting the deck panels to the side walls. In one embodiment, this system includes first connector means, generally indicated at 247, associated with the side walls 11, and second connector means, generally indicated at 248, associated with the deck panels 14 adjacent opposite ends thereof. In the preferred embodiment, connector means 247 comprises a plurality of pins 250 projecting upwardly from the tops of the side walls 11, and means 248 comprises a plurality of generally key-hole-shaped slots, indicated generally at 252, formed in the horizontal portions 246 of the end caps 242 at the upper ends of the side walls 11. It is to be understood that the slots 252 could be associated with the side walls 11 and the pins 250 with the deck panels 14 and still fall within the scope of the present invention.

Each pin 250 has an upwardly projecting shank 254 and a head 256 at the top of the shank having a larger diameter D1 than the shank. Each slot 252 includes a first relatively wide portion 258 sized for receiving the head 256 and shank 254 from a first direction (indicated by arrow 257 in FIG. 17). The slot 252 also includes a second narrower portion 260 contiguous with the first portion and sized for receiving the shank as the pin 250 is moved in a second direction (indicated by arrow 261 in FIG. 17) generally perpendicular to the first direction. The narrower portion 260 is sized smaller than the head 256 to prevent withdrawal of the pin 250 from the slot 252 by movement in a third direction (indicated by arrow 263 in FIG. 17) opposite the first direction.

Figure 18:
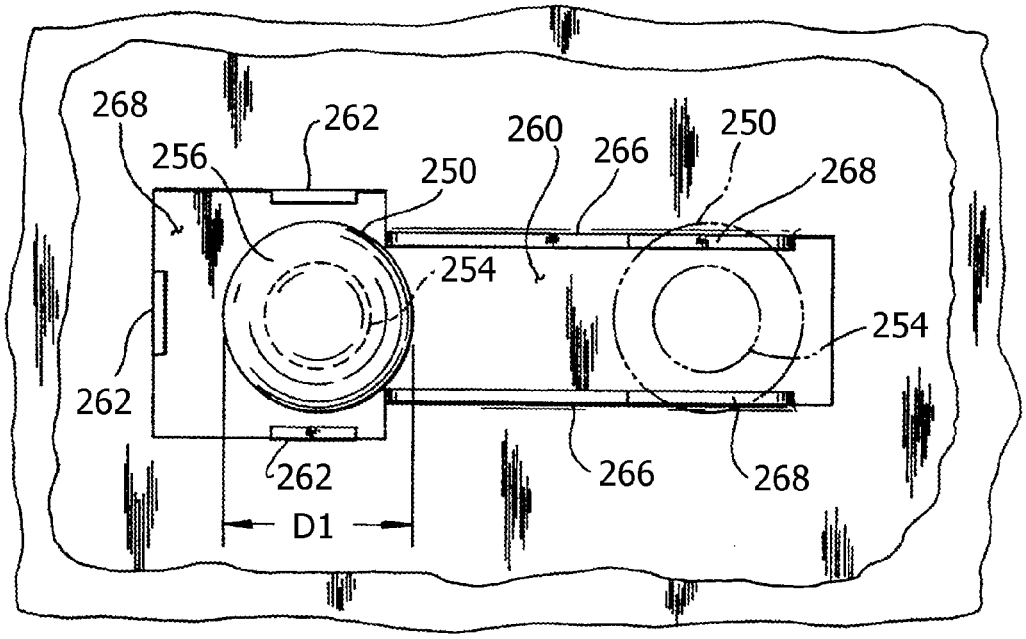
FIG. 18 is an enlarged fragmentary horizontal section showing a slot in one of the deck panels receiving a pin on one of the side walls for connecting the deck panel to the side wall.
Figure 19:
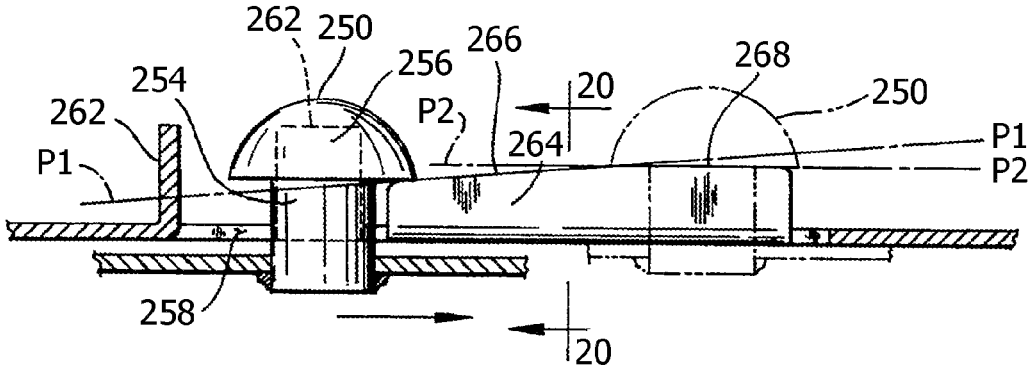
FIG. 19 is an enlarged fragmentary vertical section corresponding to FIG. 17.
Figure 20:
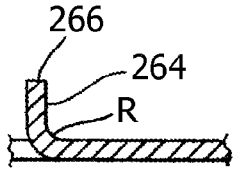
FIG. 20 is an enlarged fragmentary section taken in the plane including line 20-20 of FIG. 18.
Figure 21:
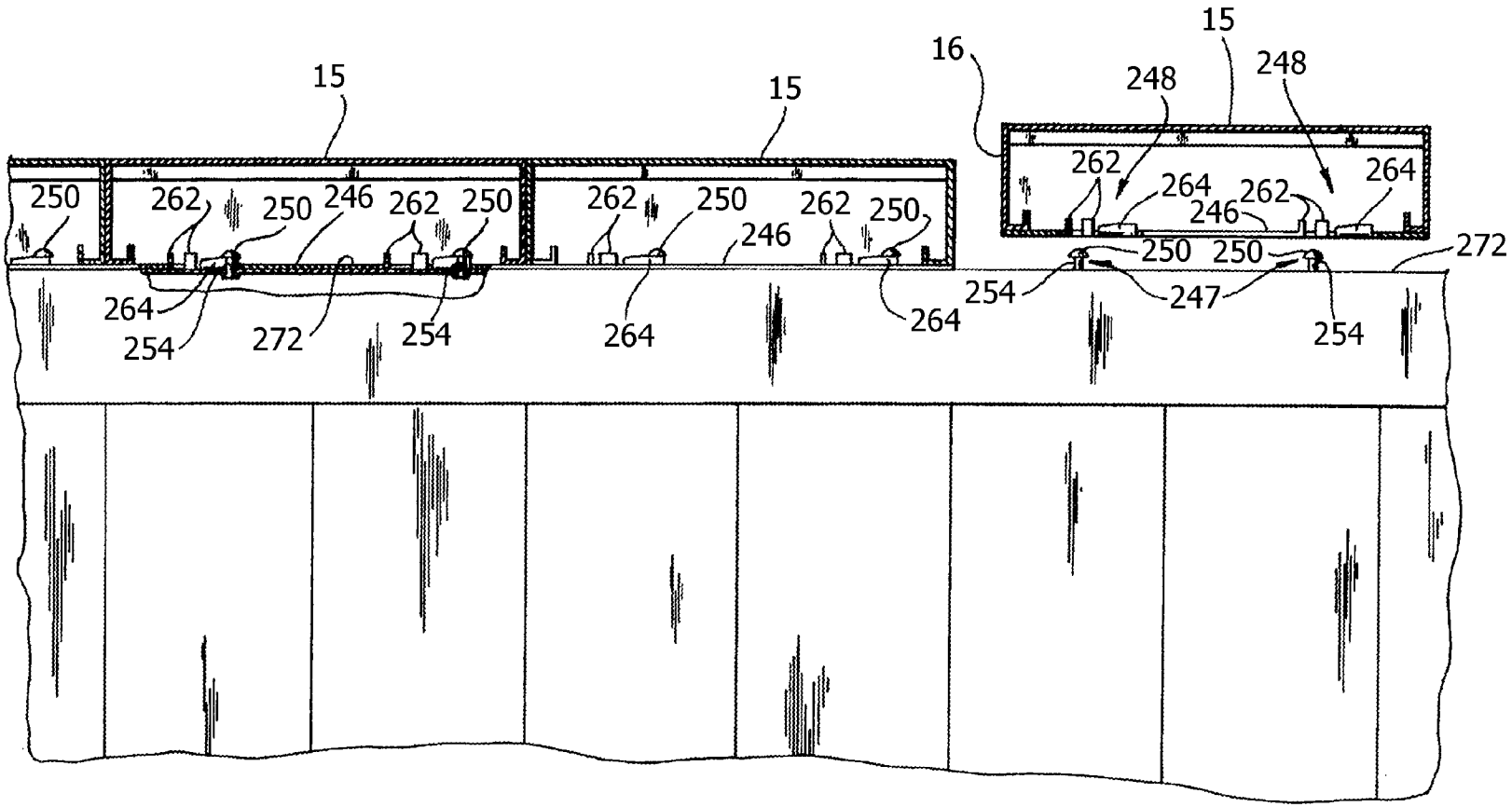
FIG. 21 is a fragmentary elevation of one of the structures adjacent its upper end as indicated by line 21-21 of FIG. 1.

As shown in FIGS. 18 and 19, a plurality of tabs 262 (broadly "retainer means") are formed integrally with the horizontal portion 246 of each deck panel end cap 242. The tabs project upwardly out of the plane of the slot 252 generally at the perimeter of its wide portion 258 and same to retain the head 256 of the pin within the perimeter of this portion of the slot upon insertion therein. One of the tabs 262 is located on each of three sides of the generally square portion 258. The fourth side of the slot portion 258 opens to the narrower portion 260 of the slot. The tabs 262 facilitate withdrawal of the pin 250 from the slot 252 upon disassembly of the structure 10 by preventing the head 256 of the pin from catching on the horizontal portion 246 of the end cap 242 surrounding the wide portion 258 of the slot.

A pair of ramps 264 (broadly "pulling means"), one disposed along each of the two longitudinal edges of the narrower portion 260 of the slot 252, are integrally formed from the horizontal portion 246 of the end cap 242 and project upwardly from the horizontal portion. As shown in FIG. 18, the ramps 264 are formed with a radius bend R. Upwardly facing ramp surfaces 266 lie generally in a plane P1 intersecting the plane of the horizontal portion 246 of the end cap. The plane P1 of the ramp surfaces 266 slopes upwardly away from the wide portion 258 of the slot. Thus, the vertical spacing between the sloped ramp surfaces and the horizontal portion 246 of the end cap is at a minimum at the ends of the ramp surfaces adjacent portion 258 of the slot and at a maximum at the opposite ends of the ramp surfaces. At the ends of the sloped ramp surfaces 266 opposite the wide portion 258 of the slot are ramp surfaces 268 lying in a generally horizontal plane P2 parallel to the plane of the horizontal portion 246 of the end cap.

When a pin 250 is moved into the narrower portion 260 of its respective slot 252 by movement in the second direction 261 lying in a plane parallel to the plane of the horizontal portion 226 of the end cap, the underside of the head 56 engages the ramp surfaces 266 so that as the pin is moved further into the narrower portion of the slot the ramps pull the pin further through the slot to bring the deck panel 14 into secure engagement with the side wall 11. This action is illustrated in FIG. 19, where the pin 250 is shown in phantom is fully inserted into the narrower portion 260 of the slot. In this fully interlocked position, the pin head 256 rests on the horizontal ramp surfaces 268 so that the pins do not tend to slide back down the ramps 264 because of the tension on the pins. The ramps 264 compensate for dimensional tolerances in different pins 250 and ramps by deforming inwardly in response to forces applied by the pin as it slides up the ramp surfaces 66, so that the deck panel 14 is drawn into tight engagement with the side wall 11. The radius R allows the ramps 264 to flex without being permanently deformed or fracturing. However, the ramps 264 may be somewhat plastically deformed and still fall within the scope of the present invention. Thus, a close fit between the deck panel 14 and side wall 11 is achieved, and the structure 10 may be easily sealed.

Figure 17:
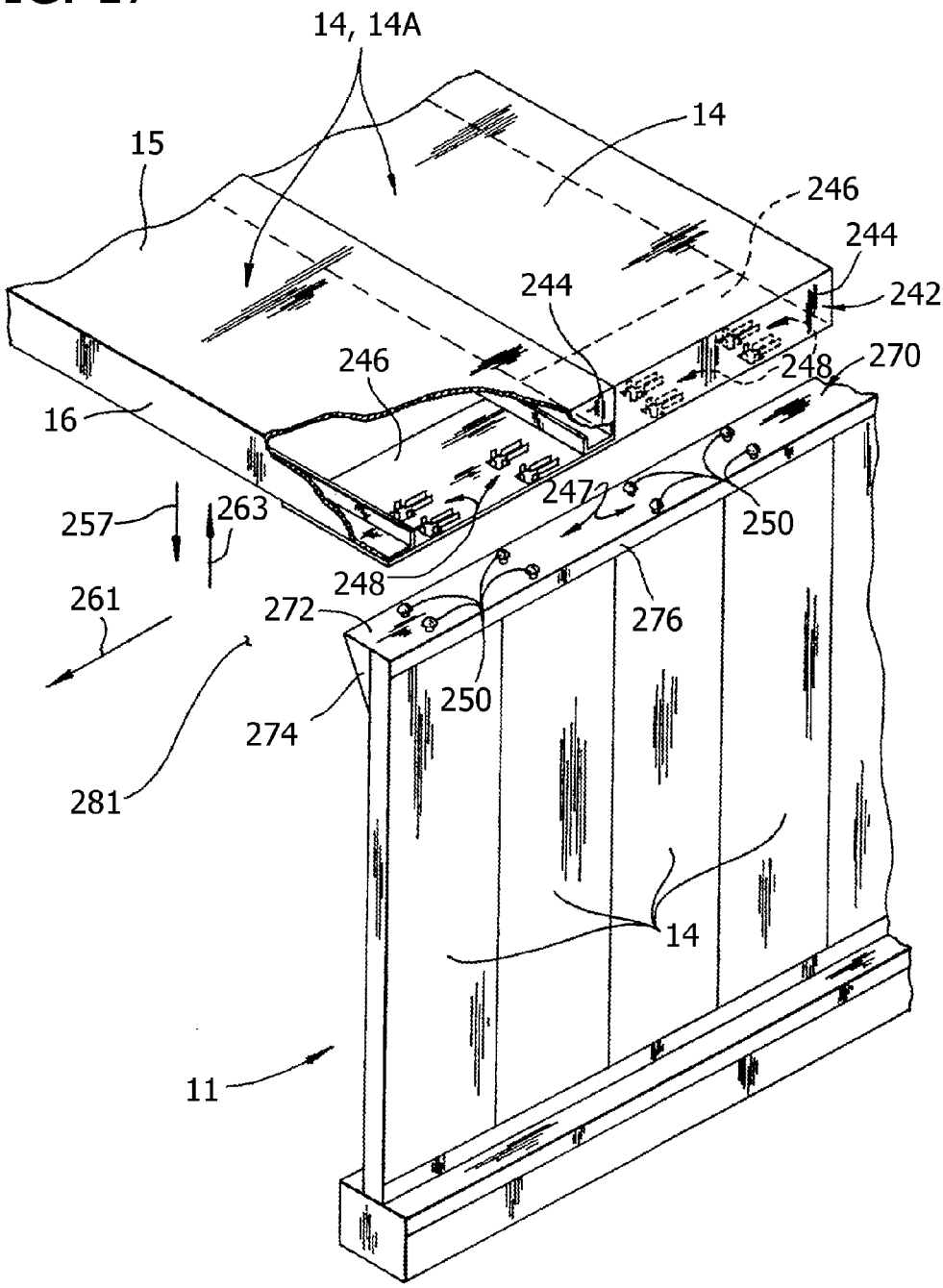
FIG. 17 is an exploded partial perspective of a bayonet connection system for connecting side walls and deck panels of a ventilation structure of this invention.

Referring now to FIG. 17, the upstanding pins 250 are formed on shelf members, indicated generally at 270, at the upper ends of the side walls 11. The shelf members 270 each include a top shelf 272 located at the top of the side wall 11. These shelf members are wider than the side wall so that they project laterally inwardly from the side wall. Each shelf member 270 has a plurality of gussets 274 which engage the top shelf 272 and the inside of the side wail to support the overhanging portion of the top shelf. The opposite longitudinal edge margin of the top shelf 272 is formed with a downwardly turned lip 276 engageable with the outside of the side wall 11 for locating the shelf member 270 on the side wall. The top shelf 272 is sized so that the shelf member 270 may also be used with wider masonry side walls, which are commonly used in mine structures.

Thus it may be seen that the several objects of the invention are arraigned and other advantageous results achieved by the structure 10 of the present invention. More specifically, the structure can be quickly erected by constructing opposing side walls 11 either from masonry (not shown) or from steel wall panels 224 (as shown herein). The deck panels 14 can be quickly secured on the side walls 11 in close side-by-side relation by lifting them to a position in which the ends of the deck panels are above the side walls, and lowering the deck panels in the first direction 257 along a generally vertical line lying in a plane parallel to the planes of the side walls toward the upper ends of the side walls. The workmen manipulate the deck panel 14 so that the slots 252 in the end caps 242 of the deck panels are generally aligned with the pins 250 on the side walls so that each pin is received through a corresponding wide portion 258 of the slot, for interengaging the pin 250 and the slot 252.

By moving the deck panels 14 in the second direction 61 along a generally horizontal line lying in a vertical plane parallel to the plane of the side walls 11, the shank 254 of the pin passes from the wide portion 258 of the slot into the narrower portion 260 and the underside of the pin head 256 engages the ramp surfaces 266. Once inserted into the narrower portion 260 of the slot, the pin 250 may not be withdrawn from the slot 252 by upward movement of the deck panel in the stated third vertical direction 263 opposite the first direction 257. As the pin 250 progresses further into the narrower portion 260 of the slot, it is drawn further through the slot by the ramps 264 so that the deck panel 14 is interlocked with the side wall 11, as shown in phantom in FIGS. 18 and 19. This facilitates the construction of a structure 10 which is sturdy and in which each deck panel 14 is held securely against the top shelf 272 and against the adjacent deck panel. The ramps 264 may flex inwardly toward the shank 254 as the pin slides along the ramp surfaces 266 so that a secure fit is achieved despite dimensional variations between different pins and ramps. Moreover, sealing of the structure 10 is facilitated because there are very few gaps between the deck panels 14 and the side walls 11, and because adjacent deck panels are located in a tight side-by-side engagement.

Construction of the deck 28 is accomplished by first attaching a deck panel 14 at the near ends of the side walls 11, as seen in FIG. 17, and then connecting an adjacent deck panel 14, 14A. Construction continues by connecting the next adjacent deck panel 14, 14A, and so on until the deck is completed to the far ends of the side walls 11. This order of construction is necessary in this embodiment of the invention so that each deck panel 14, 14A will have room to slide along the walls into its locked position closely adjacent the previously attached panel. However, connecting means not requiring this order of assembly still falls within the scope of the present invention.

The structure 10 of the present invention may also be quickly disassembled. More particularly, the deck panels 14 may be removed from the side walls 11 by sliding the deck panel so that the pin 250 moves out of the narrower portion 260 of the slot back into the wide portion 258. Of course, in the illustrated embodiment disassembly of the deck panels 14 from the side walls 11 begins at the ends of the side walls opposite those at which assembly began. The retainer tabs 262 engage the head 256 of each pin and prevent it from becoming hung up on the horizontal portion 246 of the end cap 242 so that the deck panel may then be easily raised off the side wall without the pin heads catching on the horizontal portion. The structure 10 may then be further broken down and removed to a new site in the mine where it can be reassembled.

Other connection systems may be used for connecting the deck panels 14 and side walls 11 of mine ventilation structures of the present invention.

The embodiments described above, as well as others within the scope of the invention, integrate a bridge into a mine ventilation structure. The structure may then be used to channel air (e.g., as an undercast or overcast) and to support vehicle traffic over the structure.

In many embodiments, the reinforced members of the structure are significantly lighter, easier to handle and easier to transport than a similar type bridge section. The reinforced members can be made about the same size as an ordinary deck member, so they can be transported more easily. In some embodiments, the reinforced members and the other members of the deck are small enough to fit in a mine elevator or a standard truck.

Moreover, the reinforced members of some embodiments do not affect the air handling or airflow through the structure. Rather, the members increase the strength of 'runners' over which vehicles may traverse.

When introducing elements of various aspects of the present invention or embodiments thereof, the articles "a", "an", "the" and "said" are intended to mean that there are one or more of the elements. The terms "comprising", "including" and "having" are intended to be inclusive and mean that there may be additional elements other than the listed elements. Moreover, the use of "top" and "bottom", "front" and "rear", "above" and "below" and variations of these and other terms of orientation is made for convenience, but does not require any particular orientation of the components.

As various changes could be made in the above constructions, methods and products without departing from the scope of the invention, it is intended that all matter contained in the above description or shown in the accompanying drawings shall be interpreted as illustrative and not in a limiting sense. Further, all dimensional information set forth herein is exemplary and is not intended to limit the scope of the invention.

What is claimed is:

1. A mine ventilation and bridge structure for installation in a mine, said ventilation and bridge structure intergrating a bridge and mine ventilation structure to enable a mine vehicle to cross over said ventilation and bridge structure, said ventilation and bridge structure comprising, a pair of generally parallel, spaced-apart side walls defining opposing side walls of the first lower passage, a plurality of elongate deck panels extending between the side walls and forming a roof of the first lower passage and a floor of the second upper passage, each deck panel comprising, in transverse cross section, a generally planar web and one or more stiffening members on the web, the deck panels being adapted to be placed on the side walls in a side-by-side relation with the deck panels closely adjacent one another so that the webs of the panels form a substantially continuous deck surface, the deck panels so placed being capable of independently supporting their own weight, and at least one deck panel of said plurality of deck panels being a reinforced bridge deck panel constructed such that the mine ventilation and bridge structure can support the weight of a vehicle crossing over the mine ventilation and bridge structure, said reinforced bridge deck panel comprising a reinforcing structure comprising either a beam or a truss extending lengthwise of the bridge deck panel substantially the full length of the bridge deck panel below the web of the bridge deck panel, and wherein said at least one reinforced bridge deck panel is constructed such that the mine ventilation and bridge structure is intergrated and capable of supporting a minimum vehicle load of at least 700 pounds.

2. A mine ventilation and bridge structure as set forth in claim 1 wherein the upper web and one or more stiffening members of the reinforced bridge deck panel have a first vertical side profile, and wherein said reinforcing structure has a second vertical side profile different from the first side profile.

3. A mine ventilation and bridge structure as set forth in claim 2 wherein said second side profile does not extend substantially below said first side profile.

4. A mine ventilation and bridge structure as set forth in claim 1 wherein more than one of said plurality of deck panels is a reinforced bridge deck panel, and wherein more than one of said plurality of deck panels is not a reinforced bridge deck panel.

5. A mine ventilation and bridge structure as set forth in claim 1 wherein said one or more stiffening members comprise side flanges depending from the web adjacent opposite sides of the deck panel.

6. A mine ventilation and bridge structure as set forth in claim 5 wherein said reinforcing structure comprises a beam secured to the underside of the web of the reinforced bridge deck panel between said side flanges.

7. A mine ventilation and bridge structure as set forth in claim 6 wherein said beam does not project below the side flanges of the reinforced bridge deck panel.

8. A mine ventilation and bridge structure as set forth in claim 5 wherein said reinforcing structure comprises a truss secured to the underside of the web of the reinforced bridge deck panel between said side flanges.

9. A mine ventilation and bridge structure as set forth in claim 8 wherein said truss does not project below the side members of the reinforced bridge deck panel.

10. A mine ventilation and bridge structure as set forth in claim 1 wherein said reinforcing structure comprises a truss comprising a first series of lower plates hinged together to form a chain of plates spaced below the deck surface, and a second series of tie plates connecting the chain of plates and a respective deck panel.

11. A mine ventilation and bridge structure as set forth in claim 10 wherein the tie plates and the plates of said chain of plates are oriented generally parallel to the direction of air flow through the lower passage to reduce air resistance.

12. A mine ventilation and bridge structure as set forth in claim 1 wherein each deck panel of said plurality of deck panels is connected to the side walls by the same connecting system.

13. A mine ventilation and bridge structure as set forth in claim 12 wherein said connecting system comprises a bayonet connection system for removably connecting opposite ends of each deck panel of said plurality of deck panels to respective side walls.

14. A mine ventilation and bridge structure as set forth in claim 1, wherein said mine ventilation and bridge structure is an overcast, and further comprising a first upwardly inclined ramp connected to one side of the mine ventilation and bridge structure for passage of a vehicle up the ramp onto said reinforced bridge deck panel, and a second downwardly inclined ramp connected to an opposite side of the structure for passage of the vehicle from said reinforced bridge deck panel back to the floor of the mine.

15. A mine ventilation and bridge structure as set forth in claim 14 wherein at least one of said first and second ramps is a multi-section ramp comprising a plurality of ramp sections, including a first ramp section inclined at a first angle and a second ramp section inclined at a second angle less than the first angle.

16. A mine ventilation and bridge structure as set forth in claim 15 further comprising a hinge joint between said first and second ramp sections, and a stand adjacent the hinge joint for supporting the multi-section ramp on the mine floor.

17. A mine ventilation and bridge structure as set forth in claim 16 wherein said stand comprises a pair of vertical supports on opposite sides of the multi-section ramp, and a cross support connected to the vertical supports and underlying the multi-section ramp for supporting the ramp, each vertical support of said pair of vertical supports comprising a lower support member and an upper support member having a telescoping fit with the lower support member for accommodating mine convergence.

18. A mine ventilation and bridge structure as set forth in claim 14 wherein at least one of said first and second ramps is arched upwardly.

19. A mine ventilation and bridge structure as set forth in claim 14 wherein said first and second ramps having traction means thereon for providing increased traction for said vehicle.

20. A mine ventilation and bridge structure as set forth in claim 1 wherein said plurality of deck panels comprises a number of deck panels which are not reinforced for supporting the weight of a vehicle, and wherein said reinforced bridge deck panel has a vertical profile transverse to the direction of airflow through the lower passage not greater than the vertical profile of the non-reinforced deck panels.

21. A mine ventilation and bridge structure as set forth in claim 1 wherein said reinforcing structure is fabricated entirely from component parts having lengths no greater than forty feet to facilitate transport of the component parts into the mine and assembly inside the mine.

22. A mine ventilation and bridge structure as set forth in claim 1 wherein said deck panels are formed of sheet metal and the upper web of said reinforced bridge deck panel has traction means thereon for providing increased traction for said vehicle.

23. A mine ventilation and bridge structure as set forth in claim 1 wherein said at least one reinforced bridge deck panel is constructed such that the mine ventilation and bridge structure can support a minimum vehicle load of at least 10,000 pounds.

24. A mine ventilation and bridge structure as set forth in claim 1 wherein said at least one reinforced bridge deck panel is constructed such that the mine ventilation and bridge structure can support a minimum vehicle load of at least 50,000 pounds.

* * * * *